United States Patent [19]

Green

[11] 4,382,724

[45] May 10, 1983

[54] HOPPER DISCHARGE ARRANGEMENT

[75] Inventor: Daniel R. Green, Griffith, Ind.

[73] Assignee: Union Tank Car Company, East Chicago, Ind.

[21] Appl. No.: 259,290

[22] Filed: Apr. 30, 1981

[51] Int. Cl.[3] ..... B65G 53/50; B61D 7/22

[52] U.S. Cl. ..... 406/130; 105/282 P; 105/308 E; 292/257; 406/145

[58] Field of Search ..... 105/280, 283, 282 P, 105/308 E, 308 R, 377; 222/267, 274, 545, 551, 554; 292/216, 238, 257, 259; 406/68, 118, 122, 128, 129, 130, 131, 138, 145

[56] References Cited

U.S. PATENT DOCUMENTS

| | | | |
|---|---|---|---|
| 3,527,503 | 9/1970 | Mundinger | 406/129 |
| 3,588,181 | 6/1971 | Nagy | 406/145 |
| 3,637,262 | 1/1972 | Adler | 406/128 |
| 3,797,891 | 3/1974 | Fritz | 406/131 X |
| 4,062,596 | 12/1977 | Kull | 406/145 |
| 4,312,607 | 1/1982 | Van Auken | 406/145 X |

*Primary Examiner*—Randolph Reese
*Assistant Examiner*—David F. Hubbuch
*Attorney, Agent, or Firm*—Dressler, Goldsmith, Shore, Sutker & Milnamow, Ltd.

[57] ABSTRACT

An enclosed railroad hopper car has a valve that controls the discharge of the commodity it carries. The valve is opened and closed by an operating mechanism that is subjected to vibration and inertial forces during transit. This can jar open the valve. A cap for the discharge hopper outlet opening interlocks with the valve operating mechanism when the valve is closed so as to prevent the valve from opening. The cap is held in its open position by a trap that prevents it from swinging closed while the car is being unloaded.

13 Claims, 5 Drawing Figures

HOPPER DISCHARGE ARRANGEMENT

BACKGROUND OF THE INVENTION

This invention relates to the transportation of solid commodities in vehicles, and more particularly to unloading mechanisms for railroad hopper cars.

The discharge of commodities from railroad cars having outlet hoppers is frequently controlled by valves. When a car is loaded, the valves are closed to prevent loss or damage to the commodity during transit. These valves are opened and closed by an operating mechanism that is subject to vibration and inertial forces as the car stops, starts, and moves along the rails. This can result in jarring of the operating mechanism sufficiently to open a valve and cause damage to or loss of the commodity.

The commodity outlet openings are usually sealed by a removable cap. To prevent loss of such a cap, it sometimes remains connected to a hopper even after it has been removed from the outlet opening. However, these attached caps can cause damage or injury, and can themselves be damaged, when movement of the car occurs while the caps are in their open position.

OBJECTIVES OF THE INVENTION

Accordingly, it is an object of this invention to provide an improved vehicle for transporting a solid commodity.

Another object is to prevent loss or damage to a commodity being transported or stored in a container by preventing inadvertent opening of an unloading valve.

Another object is to prevent the motion of a vehicle from damaging parts of an unloading hopper or from causing the hopper to be jostled open.

Another object is to hold an attached closure cap in its open position by positive restraining means.

Another object is to provide a railroad car with an outlet hopper that is durable, rugged, relatively inexpensive, and easy to open, close and maintain, and which does not present a sefety hazard to workers and does not possess defects found in similar prior art devices.

Other objects and advantages of the invention will be found in the specification and claims, and the scope of the invention will be set forth in the claims.

DESCRIPTION OF A PREFERRED EMBODIMENT

Figure 1:
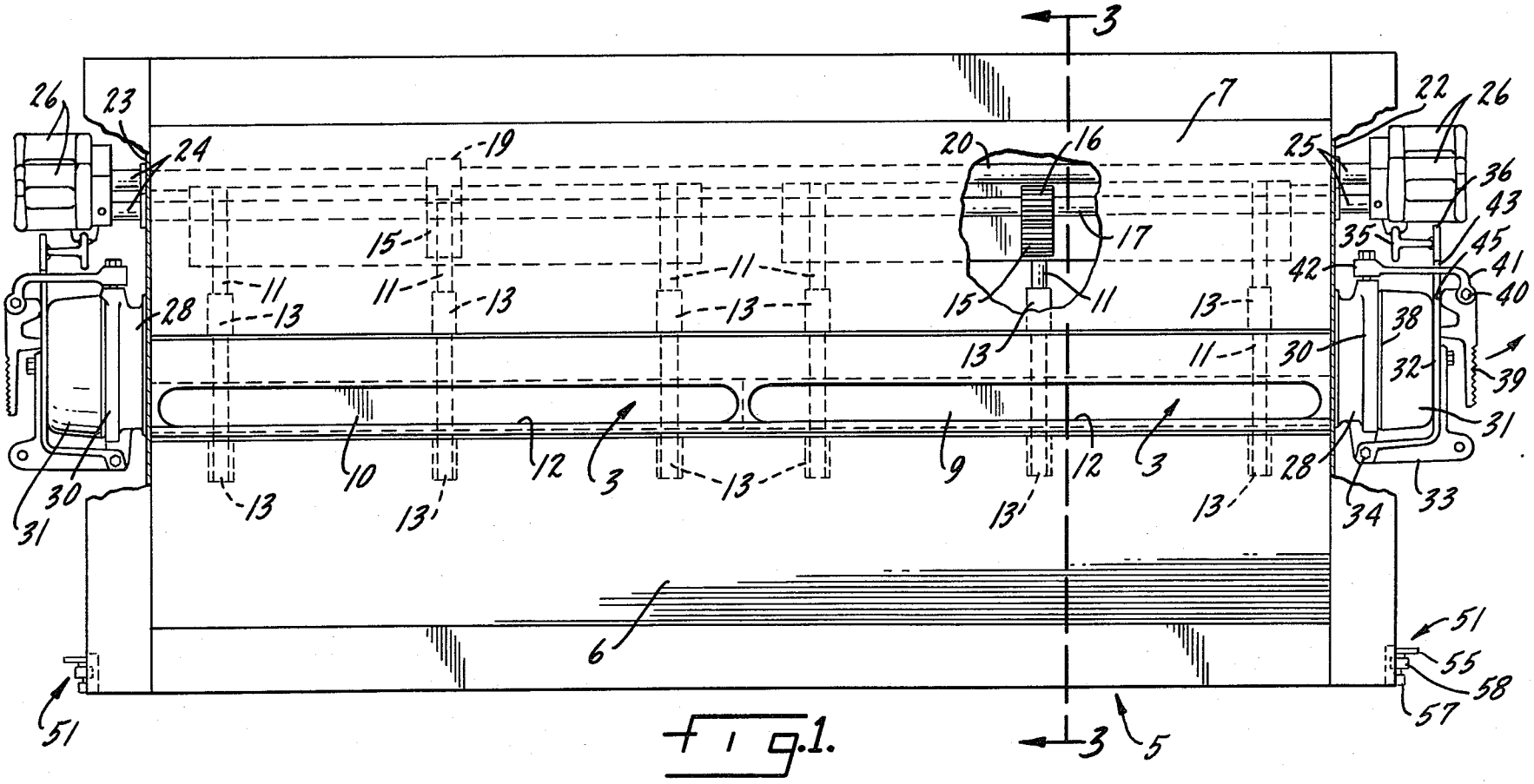
FIG. 1 is a top plan, partially broken away, view of a railroad hopper car in accord with this invention.
Figure 2:
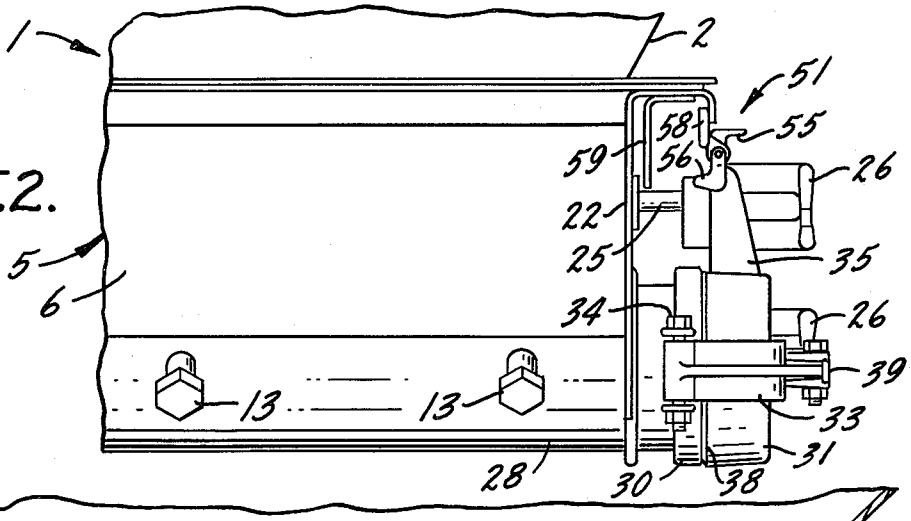
FIG. 2 is a partial side view of the car shown in FIG. 1.
Figure 3:
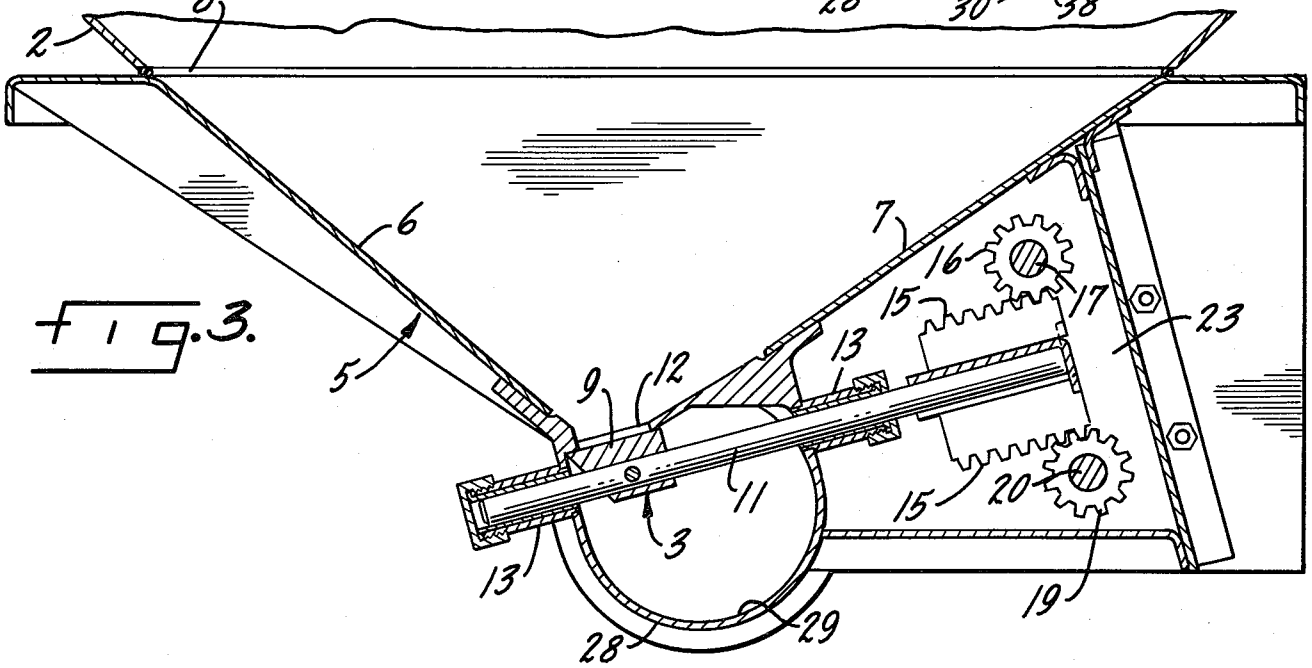
FIG. 3 is a cross sectional view taken along the line 3—3 in FIG. 1.

The drawing shows a railroad hopper car 1 having an enclosed container or tank body 2 for storing and transporting along rails 4 a solid commodity, such as pellets of PVC, ABS or other plastics. Flow through commodity discharge openings 8 at the underside of car 1 is controlled by slide valves 3 in hoppers 5 having sloping surfaces 6 and 7. Each valve 3 may be split into two segments 9 and 10 to permit greater control over the rate at which the commodity is discharged; this can be accomplished by opening only one of the segments 9 or 10 or by opening one segment more than the other. Valve segments 9 and 10 each are mounted on spaced operating rods 11 for sliding movement directly below elongated discharge slot 12 of hopper 5. Rods 11 are supported in bearings 13, and a rack 15 is attached to the rod 11 at the center of each valve segment. A gear 16 on a rotatable shaft 17 mates with the rack 15 on valve segment 9, and a gear 19 on a rotatable shaft 20 mates with the rack 15 on valve segment 10. Shafts 17 and 20 are supported by sides 22 and 23 of hopper 5, and both ends 24 and 25 of each shaft 17 and 20 extend beyond the respective sides 22 and 23. Each end 24 and 25 of each shaft 17 and 20 is attached to a first operating handle 26. Rotation of either handle 26 on shaft 17 causes gear 16 to turn, and this moves the rack 15 attached to valve segment 9. Rotation of either handle 26 on shaft 20 causes gear 19 to turn, and this moves the rack 15 attached to valve segment 10. Either segment 9 or 10 can be moved from a fully opened to a fully closed position, or vice versa, by rotating one of its handles 26 less than one full turn. Thus, the position of each valve segment 9 or 10 below discharge slot 12 can be adjusted independently of the other valve segment by turning of the proper handle 26, and each valve segment can be adjusted from either side of car 1.

A hollow, generally circular, tubular housing 28 is attached to the underside of hopper 5. The inside of housing 28 defines a commodity discharge trough 29 beneath slot 12. The opposite terminal ends 30 of trough 29 extend beyond hopper 5 and define the outlets for the commodity being discharged from car 1. Each outlet end 30 is sealed by a removable cap 31. An arm 32 is attached to the center of the outer surface of each cap 31. Each arm 32 is pivotally attached at one end 33 to trough 29 by a hinge 34 having a vertical axis of rotation. A second handle 35 is attached to the other end 36 of each arm 32. Each handle 35 extends vertically upwardly beyond the periphery of its cap 31. Thus, each cap 31 is pivotable about the axis of its hinge 34 away from its outlet end 30 to its open position, and toward its outlet end 30 to its closed position. Each cap 31 is locked into sealing engagement with a gasket 38 on its ends of trough 29 by a cam lever 39. Each lever 39 is pivotally attached at one end to a vertical hinge 40 on a link 41. Each link 41 is pivotally attached at its other end to a horizontal hinge 42 on trough 29. Each link 41 is received in a vertical notch 43 in its associated arm 32, and a cam surface 45 on each lever 39 bears against the outer surface of its arm 32. Conventional car seals may be used between levers 39 and arms 32.

The vibrations and inertial forces that occur when car 1 is in motion can jar the operating mechanism for valve segments 9 and 10 sufficiently to jostle the valves open. This invention provides means preventing rotation of operating shafts 17 and 20 so as to hold valve segments 9 and 10 closed when caps 31 are in closed position. When valve segments 9 and 10 are closed, all handles 26 on shafts 17 and 20 will be in essentially the positions shown in FIG. 4, and each handle 26 will provide a substantially flat vertical first surface 47. When caps 31 are in closed position, the handle 35 on each cap 31 will provide a substantially flat vertical second surface 48. A block 50 attached to and extending outwardly from each cap 31 also has a substantially flat vertical second surface 48. Handles 26 are eccentrically mounted on shafts 17 and 20 in such a manner that handle 35 will swing past handle 26 to the closed position for cap 31, and surface 47 will be properly positioned to mate with surface 48 only when valve segments 9 and 10 are closed. The engagement between surfaces 47 and 48 prevents movement of shafts 17 and 20, and hence prevents movement of car 1 from causing valve segments 9 and 10 to open.

When car 1 is to be unloaded, cam levers 39 are pivoted away from arms 32, links 41 are removed from notches 43, and each cap 31 is pivoted to its open position. Handles 26 can then be rotated until valve segments 9 and 10 are slid open sufficiently to discharge the commodity at the proper rate. Solid commodities are usually unloaded pneumatically, in which case a suction hose would be attached to one end 30 of trough 29 while the other end 30 would be left open to permit displacement air to flow into car 1.

Figures 4, 5:
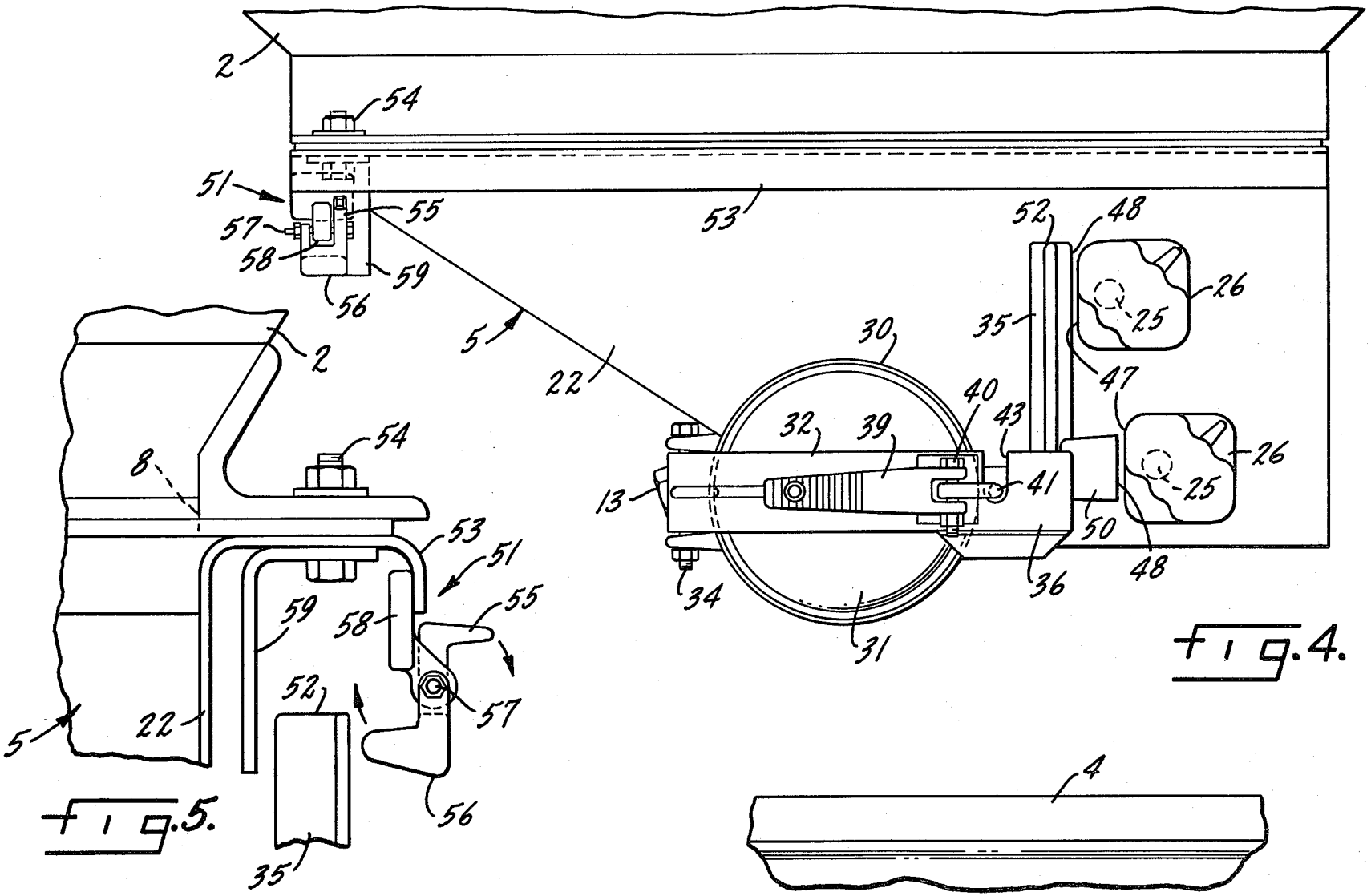
FIG. 4 is an end view of the car shown in FIG. 1.
FIG. 5 is an enlarged fragmentary view showing the handle catch for the car of FIG. 1.

After caps 31 are moved away from outlets 30 to their open position, the caps can be damaged or can cause damage or injury if car 1 happens to move. Such movement could cause caps 31 to swing against car 1 or to hit a worker. This invention provides a trap 51 that releasably holds the upper extention or end 52 of each handle 35 when its cap 31 is in its open position so as to prevent the cap from pivoting to its closed position. Each trap 51 is separated from its cap 31 in the direction the cap moves to its open position. Traps 51 are held on a flange 53 of hopper 5 by bolts 54. Each trap 51 has a catch 55 that is weighted so that it hangs in a vertical position (as shown in FIG. 5) with the same one of its ends 56 always being its lowest end. Catch 55 pivots about a horizontal axis or hinge 57, and a stop 58 prevents catch 55 from pivoting past the vertical in one direction. Thus, as each cap 31 is pivoted to its open position, the cap can be swung far enough for the upper end 52 of its handle 35 to engage the lower end 56 of a catch 55 and to pivot the lower end 56 of the cach clockwise upwardly out of the way of the handle. As the end 52 of the handle moves past the catch 55, the biasing force of the weight of the catch 55 causes the lower end 56 of the catch to pivot downwardly so that the catch is again in its vertical position. Stop member 58 prevents catch 55 from being pivoted counterclockwise past the vertical, so handle 35 is confined in trap 51 and cap 31 can not pivot back to its closed position. A handle retainer 59 may be attached to flange 53 to minimize the distance handle 35 can move in trap 51. To release a handle 35 from its trap 51, a worker first pivots the lower end 56 of catch 55 upwardly in a clockwise direction and then holds the catch above the upper end 52 of the handle while he pivots the cap 31 toward its closed position past trap 51. Then the catch 55 is released and the cap 31 can be closed against its gasket 38.

It has thus been shown that by the practice of this invention engagement of first surfaces 47 on handles 26 with second surfaces 48 on caps 31 prevent loss or damage to the commodity in car 1 by inadvertent opening of a valve segment 9 or 10 while the car is moving. The eccentric mounting of handles 26 on shafts 24, and the fact that less than one turn of a handle 26 can fully open or close a segment 9 or 10, ensures that segments 9 and 10 are closed when car 1 is sealed for transit because handle 35 can only swing past handles 26 and surfaces 47 and 48 can only be properly aligned when segments 9 and 10 are closed. After a cap 31 has been pivoted away from its outlet 30, a trap 51 will hold the cap out of the way of the unloading activity going on around the outlet, and will also prevent the cap from being swung into contact with hopper 5 or a worker if car 1 moves.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. For example, such terms as clockwise and counterclockwise should be regarded as relative directions. It is intended that the appended claims cover all such changes as fall within the true spirit and scope of the invention.

What is claimed is:

1. A hopper for unloading a commodity through an opening in a vessel, comprising:

A. valve means for controlling flow through said opening, operating means for opening and closing said valve means, said operating means having an end extending outside of said hopper;

B. means defining a commodity outlet below said opening, a removable cap for sealing said outlet, said cap being pivotable about a vertical axis toward and away from said outlet to its closed and open positions;

C. means attached to said cap engaging said end of said operating means so as to prevent movement of said operating means and thereby to hold said valve means closed when said cap is in its closed position; and D. a latching mechanism for holding said cap in its closed position including:

1. an arm attached to the center of said cap, one end of said arm being pivotable about a vertical axis;
2. a link pivoted at one end about a horizontal axis, said link being received in a vertical notch in said arm; and
3. a cam lever pivotally attached to the other end of said link, said lever being pivotable about a vertical axis and having a camming surface engaging the outside of said arm so as to lock said cap into its closed position.

2. The invention defined in claim 1, further comprising means releasably engaging said cap when said cap is in open position so as to prevent said cap from pivoting to its closed position.

3. The invention defined in claim 1, wherein said means holding said valve means closed comprises said end of said operating means having a first handle with a substantially flat first surface, and means on said cap having a substantially flat vertical second surface engaging said first surface when said cap and said valve means are both closed.

4. The invention defined in claim 3, wherein said means on said cap comprises a second handle.

5. The invention defined in claim 3, wherein said operating means comprises a rotatable shaft and said first handle is mounted off-center on said shaft so that said first and second surfaces are aligned only when said valve means is closed.

6. The invention defined in claim 3, wherein said means having said second surface comprises a block extending outwardly from said cap.

7. A railroad vehicle having a commodity discharge opening at its underside, comprising:

A. valve means for controlling material flow through said opening, an operating shaft rotatably mounted for opening and closing said valve means, said shaft having an end extending outside of said car, a first handle mounted eccentrically on said end of said shaft, said handle having a substantially flat first surface;

B. a commodity outlet trough below said opening, said trough having a terminal end sealed by a removable cap, said cap being pivotable about a vertical axis toward and away from said terminal end to its closed and open positions;

C. a latch mechanism for holding said cap in closed position comprising a cam lever pivotable about a vertical axis and having a camming surface forcing said cap into closed position; and D. a second handle on said cap having a substantially flat second surface that engages said first surface on said first handle when said valve means and said cap are both closed, engagement of said first and second surfaces preventing rotation of said operating shaft and holding said valve means closed, and the eccentric mounting of said first handle causing said first surface to be in contact with said second surface only when said cap and said valve means are both closed.

8. A hopper for unloading a commodity through an opening in a container portion of a transportation vehicle, comprising:

A. means defining a commodity outlet below said opening, a removable cap for sealing said outlet, means pivotably attaching said cap to said hopper so that said cap is pivotable toward and away from said outlet to its closed and open positions;

B. means attached to and movable with said cap, and said means extending beyond the peripheral edge of said cap; and C. a trap separated from said cap in the direction said cap moves to its open position, said means extending beyond said cap being held in said trap when said cap is in its open position so as to prevent pivoting of said cap to its closed position when said vehicle moves.

9. The invention defined in claim 8, wherein said means extending beyond said cap is a handle.

10. The invention defined in claim 9, wherein said cap pivots about a vertical axis and said trap comprises a catch pivotable about a horizontal axis on engagement by said handle.

11. The invention defined in claim 10, further comprising an arm attached to the outer surface of said cap, said arm being pivotally attached at one end to said hopper and said handle extending upwardly from its other end, the upper end of said handle being held in said trap by said catch.

12. The invention defined in claim 10, wherein said catch is weighted so that it hangs in a vertical position with the same one of its ends always being its lowest end, and said trap further comprising means engaging the upper end of said catch permitting pivoting of said catch out of the way of said handle when said handle engages said catch as said cap pivots to its open position, but said means engaging said catch and preventing said catch from pivoting when said catch is engaged by said handle as said cap pivots toward its closed position.

13. A railroad vehicle having a commodity discharge opening at its underside comprising:

A. valve means for controlling material flow through said openings, operating means for opening and closing said valve means, said operating means having an end extending outside of said car;

B. a commodity outlet trough below said opening, said trough having a terminal end sealed by a removable cap, an arm attached to the outer surface of said cap, said arm being pivotable at one end about a vertical axis, a handle attached to the other end of said arm, said handle extending upwardly beyond the periphery of said cap, said cap being pivotable about said vertical axis toward and away from said terminal end to its closed and open positions;

C. means attached to said cap engaging said end of said opening means so as to prevent movement of said operating means and thereby to hold said valve means closed when said cap is in its closed position; and D. a trap separated from said cap in the direction said cap moves to its open position, comprising:

1. a catch pivotable about a horizontal axis, said catch being weighted so that it hangs in a vertical position with the same one of its ends always being its lowest end, said catch being engagable by the upper end of said handle;

2. a member engaging the upper end of said catch permitting pivoting of said catch out of the way of said handle when said handle engages said catch as said cap pivots to its open position, but said member engaging said catch and preventing said catch from pivoting when said catch is engaged by said handle as said cap pivots toward its closed position, whereby said handle is retained in said trap and said cap is held in its open position so as to prevent pivoting of said cap to its closed position when said vehicle moves.

* * * * *